US009914610B2

(12) United States Patent
Mabuchi et al.

(10) Patent No.: US 9,914,610 B2
(45) Date of Patent: Mar. 13, 2018

(54) TENSION CONTROL DEVICE AND CONVEYING DEVICE

(71) Applicant: IHI Corporation, Tokyo (JP)

(72) Inventors: Takayuki Mabuchi, Tokyo (JP); Rui Oohashi, Tokyo (JP); Kensuke Hirata, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 15/465,327

(22) Filed: Mar. 21, 2017

(65) Prior Publication Data

US 2017/0190534 A1 Jul. 6, 2017

Related U.S. Application Data

(63) Continuation of application No. PCT/JP2015/081887, filed on Nov. 12, 2015.

(30) Foreign Application Priority Data

Jan. 14, 2015 (JP) ..... 2015-005170

(51) Int. Cl.

| | |
|---|---|
| ***B65H 20/32*** | (2006.01) |
| ***B65H 23/188*** | (2006.01) |
| ***B65H 23/192*** | (2006.01) |
| ***B65H 23/04*** | (2006.01) |
| ***B65H 23/26*** | (2006.01) |

(52) U.S. Cl.

CPC ..... *B65H 20/32* (2013.01); *B65H 23/044* (2013.01); *B65H 23/1888* (2013.01); *B65H 23/192* (2013.01); *B65H 23/26* (2013.01); *B65H 2406/111* (2013.01); *B65H 2406/1115* (2013.01)

(58) Field of Classification Search

CPC ..... B65H 23/188; B65H 23/192; B65H 23/1888; B65H 23/044; B65H 23/26; B65H 2406/111; B65H 2406/1115; B65H 20/30; B65H 20/32; B65H 20/34

See application file for complete search history.

(56) References Cited

U.S. PATENT DOCUMENTS

| | | | |
|---|---|---|---|
| 2011/0198378 | A1 | 8/2011 | Chang et al. |
| 2014/0349825 | A1 | 11/2014 | Hsu |

FOREIGN PATENT DOCUMENTS

| | | | |
|---|---|---|---|
| CN | 101773942 | A | 7/2010 |
| CN | 103787145 | A | 5/2014 |
| CN | 103958379 | A | 7/2014 |
| JP | S62-280154 | A | 12/1987 |
| JP | H2-25219 | A | 1/1990 |

(Continued)

OTHER PUBLICATIONS

Zhou Zhi-wen, et al., "Design of the Tensile Controller Based on Feed-forward and Feedback Control," Electrical Automation, 2013, 35(1), (with English abstract) pp. 38-39, 66 (3 pages).

*Primary Examiner* — William E Dondero
(74) *Attorney, Agent, or Firm* — Rothwell, Figg, Ernst & Manbeck, P.C.

(57) ABSTRACT

The present disclosure provides a tension control device including a turn bar which is disposed between an upstream device delivering a belt-shaped web and a downstream device receiving the web and of which a pressing member presses the web and a control unit which feedforward-controls a pressing force applied from the turn bar to the web on the basis of a schedule relating to a conveying speed of the web of any one of the upstream device and the downstream device.

12 Claims, 5 Drawing Sheets

(56) References Cited

FOREIGN PATENT DOCUMENTS

| | | | |
|---|---|---|---|
| JP | H2-169458 | A | 6/1990 |
| JP | 5-155488 | A | 6/1993 |
| JP | H6-321397 | A | 11/1994 |
| JP | 2001-213557 | A | 8/2001 |
| JP | 2001-286809 | A | 10/2001 |
| JP | 3541895 | B2 | 7/2004 |
| JP | 2005-506257 | A | 3/2005 |
| JP | 2005-200216 | A | 7/2005 |
| JP | 3668628 | B2 | 7/2005 |
| JP | 2006-27765 | A | 2/2006 |
| JP | 2011-168403 | A | 9/2011 |
| JP | 2012-224456 | A | 11/2012 |
| JP | 2013-245027 | A | 12/2013 |
| TW | M402298 | U1 | 4/2011 |
| WO | 03/033384 | A1 | 4/2003 |

TENSION CONTROL DEVICE AND CONVEYING DEVICE

CROSS-REFERENCE TO RELATED APPLICATIONS

The present application is a continuation application of International Application No. PCT/JP2015/081887, filed Nov. 12, 2015, which claims priority to Japanese Patent Application No. 2015-005170, filed Jan. 14, 2015. The contents of these applications are incorporated herein by reference in their entirety.

TECHNICAL FIELD

The present disclosure relates to a tension control device and a conveying device.

BACKGROUND

Patent Document 1 below discloses a buffer device which includes a plurality of turn bars capable of winding a film-shaped material (a belt-shaped web) conveyed between two suction rollers. In the buffer device, each of the turn bars is movable up and down, a tension of the film-shaped material is detected by a sensor such as a load cell, and a movement amount of the turn bar is controlled by a feedback control based on this detection result, thereby inhibiting bending of the film-shaped material. Further, Patent Documents 2 to 4 below also disclose related arts.

DOCUMENTS OF THE RELATED ART

Patent Document

[Patent Document 1]
Japanese Unexamined Patent Application, First Publication No. 2013-245027
[Patent Document 2]
Japanese Unexamined Patent Application, First Publication No. 2006-027765
[Patent Document 3]
Japanese Unexamined Patent Application, First Publication No. 2001-213557
[Patent Document 4]
Japanese Unexamined Patent Application, First Publication No. 2005-200216

SUMMARY

Incidentally, in the buffer device disclosed in Patent Document 1 above, when a rotation speed of the suction roller is increased or decreased, the feedback control is performed on the basis of the detection result obtained by the sensor. For this reason, since a change in tension of the web is detected by the sensor and the movement amount of the turn bar is controlled on the basis of this detection result, the tension of the web cannot be adjusted immediately with respect to a change in rotation speed of the suction roller. Thus, a delay in responsiveness of a tension control occurs.

The present disclosure is made in view of the above-described circumstances and an object thereof is to improve a delay in responsiveness of a tension control compared to the related art in a tension control device controlling a tension of a conveyed web.

The present disclosure employs the following configuration as means for solving the above-described problem. A tension control device of the present disclosure includes a turn bar which is disposed between an upstream device delivering a belt-shaped web and a downstream device receiving the web and of which a pressing member presses the web in a direction substantially normal to a conveying surface of the web in the vicinity of a guide surface of the pressing member and a control unit which feedforward-controls a pressing force applied from the turn bar to the web on the basis of a schedule relating to a web conveying speed of any one of the upstream device and the downstream device.

A conveying device of the present disclosure includes an upstream device which delivers a belt-shaped web, a downstream device which receives the web, and a tension control device.

According to the present disclosure, a delay in responsiveness of the tension control can be improved compared to the related art.

DETAILED DESCRIPTION

Figure 1:
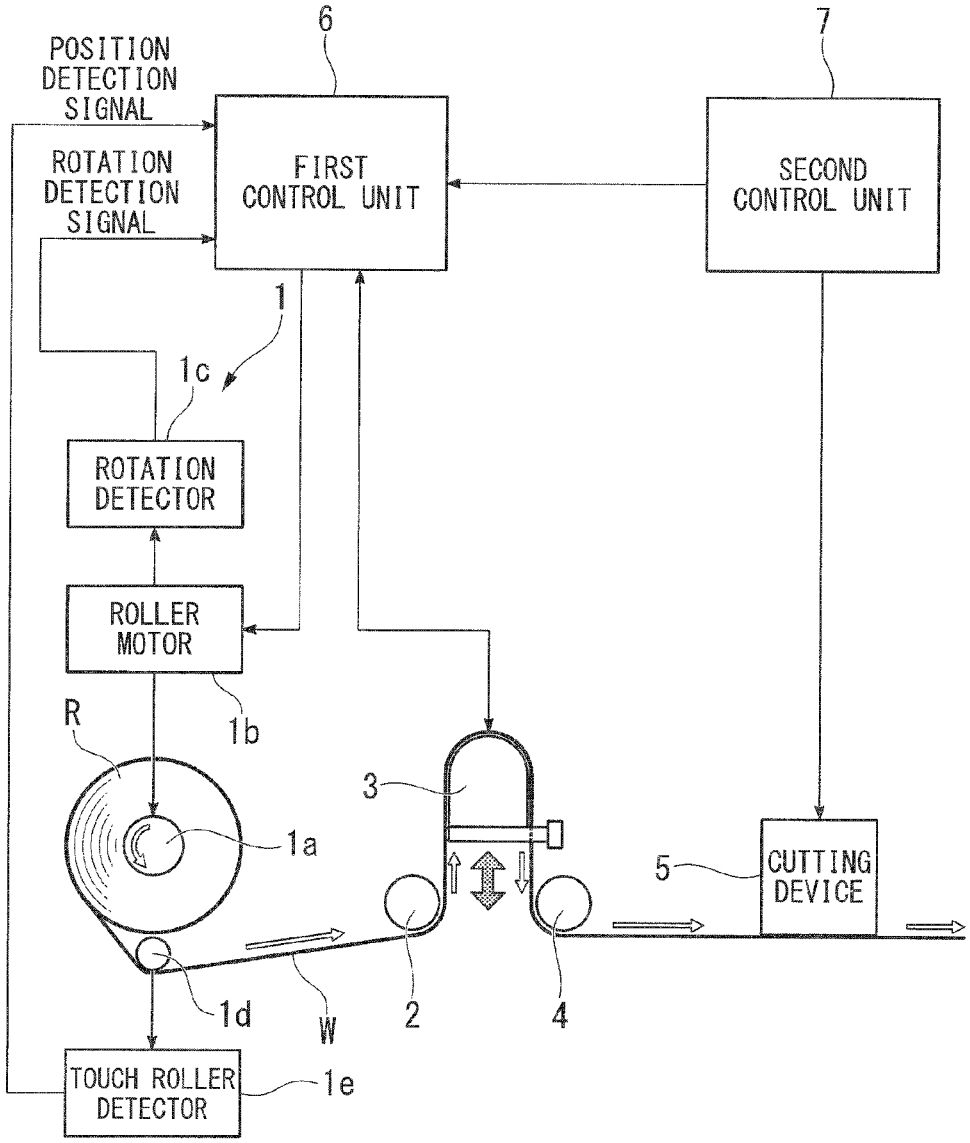
FIG. 1 is a block diagram showing a functional configuration of a web treatment device showing to an embodiment of the present disclosure.

Hereinafter, an embodiment of the present disclosure will be described with reference to the drawings. A web treatment device of the embodiment includes a web delivery device 1, an upstream guide roller 2, an air turn bar 3, a downstream guide roller 4, a cutting device 5, a first control unit 6, and a second control unit 7. Additionally, among these components, the upstream guide roller 2, the air turn bar 3, the downstream guide roller 4, and the first control unit 6 constitute a tension control device according to the embodiment. Further, the web delivery device 1 is an upstream device of the embodiment. Further, the cutting device 5 is a downstream device of the embodiment.

Such a web treatment device is a device which cuts a web W, which is delivered from the web delivery device 1 and is supplied to the cutting device 5, into a predetermined length by the cutting device 5 while uniformly maintaining a tension applied to the web W by the tension control device. Additionally, the web W is an elongated belt-shaped member having a predetermined thickness and a predetermined width and is formed of a material, such as, resin or glass.

The web delivery device 1 includes a roller shaft 1*a*, a roller motor 1*b*, a rotation detector 1*c*, a touch roller 1*d* serving as a speed detection member, and a touch roller detector 1*e* serving as a speed detector and unwinds the web W from a web roll R in which the web W is wound in a roll shape. The roller shaft 1*a* is a bar-shaped member that is inserted into a void hole provided at an axis center of the web roll R and is rotationally driven about the axis center by the roller motor 1*b*.

The roller motor 1*b* is an actuator which rotationally drives the roller shaft 1*a*. The roller motor 1*b* includes a drive circuit such as an inverter circuit or the like and a rotation speed is set on the basis of a speed control instruction input from the first control unit 6. The rotation detector 1*c* is, for example, a sensor such as a resolver or an encoder detecting a rotation state of the roller motor 1*b* and outputs a rotation detection signal representing a rotation state of the roller motor 1*b* to the first control unit 6.

The touch roller 1*d* is a driven roller which comes into press-contact with a circumferential surface of the web roll R. A position of such a touch roller 1*d* changes in accordance with a winding diameter of the web roll R. That is, since the winding diameter of the web roll R gradually decreases when the web W is sequentially delivered from the web delivery device 1, the winding diameter of the web roll R can be estimated from a conveying speed of the web W in the vicinity of the touch roller 1*d*, that is, a rotation speed of the touch roller 1*d*. The touch roller detector 1*e* outputs a speed detection signal representing the conveying speed of the web W in the vicinity of the touch roller 1*d* to the first control unit 6. Additionally, a function of the touch roller 1*d* is to detect a temporarily changing delivery speed of the web W. Thus, in the embodiment, the "touch roller 1*d*" and the "touch roller detector 1*e*" are exemplified as contact sensors, but other sensors having the same function can be used. As other sensors, a "Doppler sensor" and the like as non-contact sensors can be exemplified. The speed detection member and the speed detector can be appropriately selected depending on a required accuracy or conditions.

The upstream guide roller 2 is a driven roller which is provided parallel to the downstream guide roller 4 in the course of a conveying path of the web W. The upstream guide roller 2 and the downstream guide roller 4 are web guide members that change the conveying direction of the web W. A circumferential surface of the upstream guide roller 2 is a guide surface of the web W. The upstream guide roller 2 guides the web W in a non-contact state by for example blowing air from the circumferential surface.

The air turn bar 3 is an actuator which is provided at a downstream side of the upstream guide roller 2 so as to be movable up and down and presses the web W in a non-contact state to adjust the tension applied to the web W. As shown in the drawings, the air turn bar 3 is provided so as to be movable in an up/down direction between the upstream guide roller 2 and the downstream guide roller 4 which face each other in a parallel state. Further, an operation of the air turn bar 3 is controlled by the first control unit 6.

Figure 2:
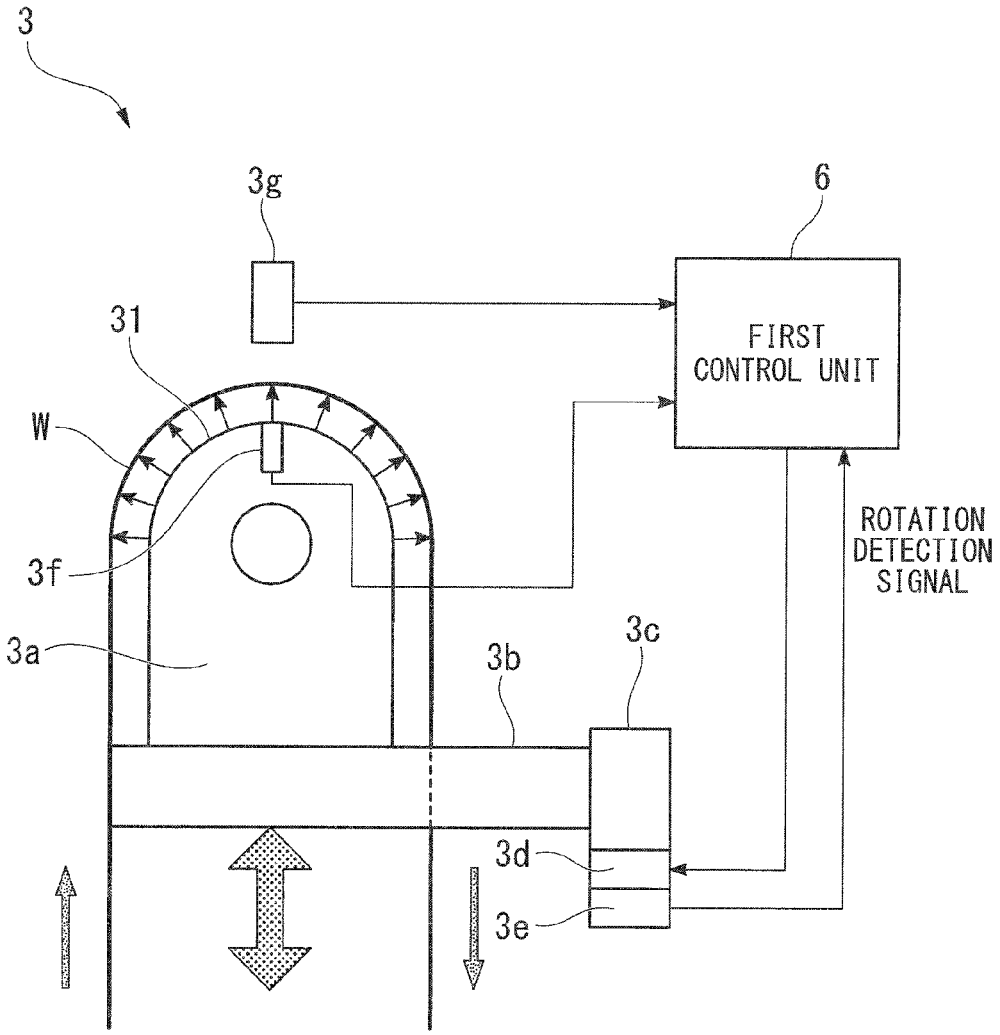
FIG. 2 is a block diagram showing a functional configuration of a tension control device according to the embodiment of the present disclosure.

Such an air turn bar 3 includes, as shown in FIG. 2, a pressing member 3*a*, a connection member 3*b*, a ball screw 3*c*, a screw motor 3*d*, a rotation detector 3*e*, a pressure sensor 3*f*, and a gap sensor 3*g*. The pressing member 3*a* presses the web W in a non-contact state to apply a desired tension thereto. The pressing member 3*a* supports the web W in a non-contact state by spraying air from the guide surface 31 which is curved in a circular-arc shape to a part of the web W traveling in a longitudinal direction. The guide surface 31 is a circular-arc surface (a cylindrical surface) which is curved about an axis following the width direction of the web W and has a width larger than the width of the web W.

As shown in the drawings, such a pressing member 3*a* holds the web W by the guide surface 31 in a curved and turned over state. Additionally, the air turn bar 3 may spray other gases (for example, an inert gas such as nitrogen) instead of air to the web W.

The connection member 3*b* is a member that connects the pressing member 3*a* and the ball screw 3*c* to each other. The ball screw 3*c* changes a position of the pressing member 3*a*. That is, the ball screw 3*c* linearly moves (directly moves) the pressing member 3*a* connected thereto through the connection member 3*b* in the up/down direction. Since the ball screw is generally known, a detailed configuration of the ball screw in FIG. 2 is omitted. However, the ball screw 3*c* has a configuration in which a bar-shaped male screw rotates so that the pressing member 3*a* connected to a female screw engaging with the male screw through the connection member 3*b* moves in a reciprocating manner (moves up and down) in a direction indicated by an arrow. Accordingly, the pressing member 3*a* can move in the up/down direction to press the web W in a direction orthogonal to the conveying direction.

Additionally, the "up/down direction" indicates an example of the "direction normal to the conveying surface of the web W in the vicinity of the guide surface 31 of the pressing member 3*a*." For example, in FIG. 1, the conveying direction of the web W becomes a direction from a left side toward a right side in a substantially horizontal direction. In general, the pressing member 3*a* presses the web W in the substantially up/down direction. That is, in FIG. 1, when the conveying direction is set to about 0°, the pressing direction (the "up/down direction") is 90°. The pressing direction may be disposed not only in the geometrically "up/down direction" (90°), but also in a substantially "up/down direction" (80° or 100°) in order to prevent interference with peripheral members. Additionally, for example, in a case where the conveying direction is a substantially "up/down direction", the pressing direction is generally a substantially "left/right direction." That is, if this is expressed comprehensively, the pressing member 3*a* presses the web W in the "direction normal to the conveying surface of the web W in the vicinity of the guide surface 31 of the pressing member 3*a*."

The screw motor 3*d* is an actuator which rotationally drives the male screw of the ball screw 3*c*. The screw motor 3*d* includes a drive circuit such as an inverter circuit or the like and rotates on the basis of a rotation control instruction input from the first control unit 6. The rotation detector 3*e* is a sensor such as a resolver, an encoder, or the like detecting a rotation state of the screw motor 3*d* and outputs a rotation detection signal representing a rotation state of the screw motor 3*d* to the first control unit 6.

The pressure sensor 3*f* is provided inside the pressing member 3*a*, that is, at the opposite side to the web W with the guide surface 31 interposed therebetween and detects a pressure of air sprayed from the guide surface 31 of the pressing member 3*a* toward the web W as an air pressure. The pressure sensor 3*f* outputs a detection value representing an air pressure to the first control unit 6.

The gap sensor 3*g* is provided to face the guide surface 31 with the web W interposed therebetween and detects a levitation height of the web W from the pressing member 3*a*, that is, a gap width between the guide surface 31 and the web W as a floating gap. The gap sensor 3*g* outputs a detection value representing the floating gap to the first control unit 6.

Returning to FIG. 1, the downstream guide roller 4 is a driven roller which is provided at a downstream side of the air turn bar 3 to be parallel to the upstream guide roller 2. The downstream guide roller 4 has exactly the same configuration as that of the upstream guide roller 2 and the downstream guide roller 4 and the upstream guide roller 2 are web guide members which change the conveying direction of the web W.

The cutting device 5 is a device that cuts the web W into a predetermined length. That is, an operation of conveying the web W is temporarily stopped at the cutting device 5 and the web is cut in this stop state. An operation of stopping and cutting the web W in such a cutting device 5 is performed under the control of the second control unit 7.

The first control unit 6 includes, for example, a CPU (Central Processing Unit), a ROM (Read Only Memory), a RAM (Random Access Memory), and an interface circuit. Additionally, the interface circuit electrically, optically, or electromagnetically communicates with the web delivery device 1, the air turn bar 3, and the second control unit 7. The first control unit 6 performs a predetermined calculation process on a rotation detection signal obtained by the rotation detector 1*c* and a speed detection signal obtained by the touch roller detector 1*e* on the basis of various control programs stored in the ROM and controls an operation of the web delivery device 1 on the basis of a calculation result.

Further, the first control unit 6 performs a predetermined calculation process on a detection value representing an air pressure obtained by the pressure sensor 3*f* and a floating gap obtained by the gap sensor 3*g* on the basis of various control programs stored in the ROM and controls air sprayed from the guide surface 31 of the pressing member 3*a* in order to uniformly maintain a distance between the web W and the guide surface 31 of the pressing member 3*a* in a non-contact state on the basis of a calculation result.

Further, the first control unit 6 drives the ball screw 3*c* by the screw motor 3*d* on the basis of a conveying speed obtained at the time in which the web W is conveyed by the web delivery device 1 and controlled by the first control unit and a conveying speed obtained at the time in which the web W is cut by the cutting device 5 and controlled by the second control unit 7. Accordingly, a position of the pressing member 3*a*, that is, a pressing force applied from the air turn bar 3 to the web W is feedforward-controlled.

Similarly to the first control unit 6, the second control unit 7 includes, for example, a CPU (Central Processing Unit), a ROM (Read Only Memory), a RAM (Random Access Memory), and an interface circuit. Additionally, the interface circuit electrically, optically, or electromagnetically communicates with the cutting device 5 and the first control unit 6. The second control unit 7 performs a calculation process on the basis of various control programs stored in the ROM and controls a process of cutting the web W by the cutting device 5 on the basis of a calculation result.

Next, an operation of the web treatment device with such a configuration will be described in detail with reference to FIGS. 3 and 4. When the web treatment device is activated, the web delivery device 1 performs a process of unwinding the web W while adjusting a speed at which the web W is delivered from the web roll R on the basis of a speed control instruction input from the first control unit 6. The delivered web W sequentially passes through the upstream guide roller 2, the air turn bar 3, and the downstream guide roller 4 to be conveyed to the cutting device 5. When the web W is conveyed, the cutting device 5 performs a process of cutting the web W while adjusting the conveying speed of the web W on the basis of a speed control instruction input from the second control unit 7.

Here, the first control unit 6 performs the following characteristic process in addition to the control of the operation of the web delivery device 1. That is, the first control unit 6 feedforward-controls a pressing force applied to the web W on the basis of a schedule relating to the conveying speed of the web W in the web delivery device 1 and the cutting device 5 and stored in the first control unit or input from the outside (for example, the second control unit 7). This schedule indicates the conveying speed of the web W or the like at the web delivery device 1 and the cutting device 5.

Specifically, the schedule includes a target speed of the web W in the web delivery device 1, a transition start timing to this target speed, and an acceleration to the target speed. The first control unit 6 creates a control value (that is, a control value of the screw motor 3*d*) relating to a position of the pressing member 3*a* so that a pressing force applied to the web W becomes uniform by the use of the target speed, the transition start timing, and the acceleration included in this schedule.

Figure 3:
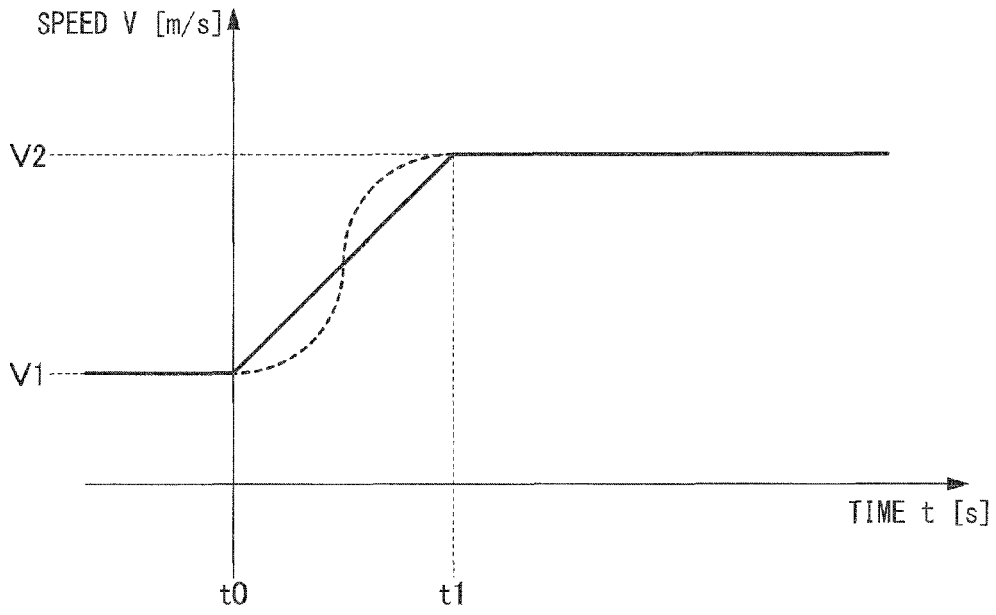
FIG. 3 is a diagram showing an example of a conveying speed when a web is delivered by a web delivery device according to the embodiment of the present disclosure.
Figure 4:
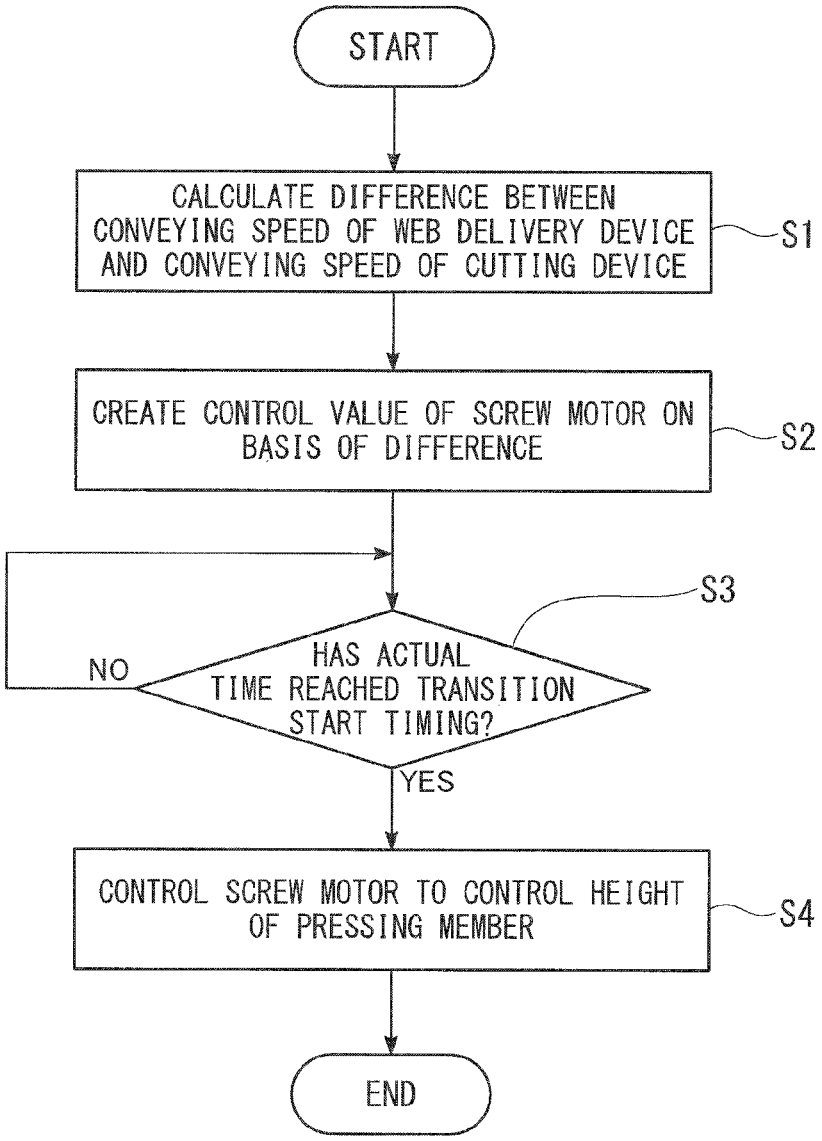
FIG. 4 is a flowchart showing an operation of the tension control device according to the embodiment of the present disclosure.

For example, in a case where the conveying speed of the web delivery device 1 is a speed V1 shown in FIG. 3 and the target speed is a speed V2 shown in FIG. 3, the acceleration is a gradient while the speed changes from the speed V1 to the speed V2. Additionally, the acceleration may be an integer in which the gradient from the speed V1 to the speed V2 is indicated by a straight solid line of FIG. 3 or a temporally changing value in which the gradient from the speed V1 to the speed V2 is indicated by a curved dashed line of FIG. 3. Accordingly, when the transition start timing (a time t0 shown in FIG. 3) to the target speed is given, the conveying speed of the web W in the web delivery device 1 at an arbitrary time during a change in speed can be calculated. Similarly, the first control unit 6 can also calculate the conveying speed of the web W in the cutting device 5.

The first control unit 6 obtains a difference between the conveying speed of the web W in the web delivery device 1 and the conveying speed of the web W in the cutting device 5 at an arbitrary time from the target speed, the transition start timing, and the acceleration and creates a control value of the screw motor 3*d* from this difference.

An operation of the web treatment device will be described in more detail by the use of a flowchart shown in FIG. 4. First, the first control unit 6 obtains a difference between the conveying speed of the web delivery device 1 and the conveying speed of the cutting device 5 from a time t0 to a time t1 shown in FIG. 3 from a schedule stored in the first control unit or input from the outside and relating to the conveying speed of the web W in the web delivery device 1 and the cutting device 5 (step S1). Further, the first control unit 6 creates a control value of the screw motor 3*d* so that a pressing force applied to the web W becomes uniform on the basis of the difference obtained in step S1 (step S2).

Subsequently, the first control unit 6 determines whether an actual time T has reached the time t0 which is the transition start timing (step S3). The first control unit 6 waits until the actual time T reaches the time t0 which is the transition start timing and controls a height (a position) of the pressing member 3*a* by controlling the screw motor 3*d* on the basis of the control value created in step S2 after the actual time T reaches the time t0 (step S4).

For example, in a case where the conveying speed of the web delivery device 1 is higher than the conveying speed of the cutting device 5, the web W bends. For this reason, the first control unit 6 controls the screw motor 3*d* so that the pressing member 3*a* moves upward in order to get a uniform pressing force. Meanwhile, when the conveying speed of the web delivery device 1 is lower than the conveying speed of the cutting device 5, the web W stretches. For this reason, the first control unit 6 controls the screw motor 3*d* so that the pressing member 3*a* moves downward in order to get a uniform pressing force.

Additionally, when a position of the pressing member 3*a* is a maximum height when the conveying speed of the web delivery device 1 is higher than the conveying speed of the cutting device 5, the first control unit 6 outputs, for example, a signal representing abnormality and stops the web treatment device without moving the pressing member 3*a* upward. Further, when a position of the pressing member 3*a* is a minimum height when the conveying speed of the web delivery device 1 is lower than the conveying speed of the cutting device 5, the first control unit 6 outputs, for example, a signal representing abnormality and stops the web treatment device without moving the pressing member 3*a* downward. Additionally, the first control unit 6 determines a position of the pressing member 3*a* on the basis of a rotation detection signal input from the rotation detector 3*e*.

According to such an embodiment, there is provided a tension control device including the air turn bar 3 which is disposed between the web delivery device 1 delivering the belt-shaped web W and the cutting device 5 receiving the web W and presses the web W in a direction orthogonal to the conveying direction and the first control unit 6 which controls the pressing force applied from the air turn bar 3 to the web W. The first control unit 6 feedforward-controls a position of the pressing member 3*a* so that a pressing force applied to the web W becomes uniform on the basis of the schedule relating to the conveying speed of the web W of at least one of the web delivery device 1 and the cutting device 5. Thus, according to the embodiment, a delay in responsiveness of the tension control can be improved compared to the related art.

Further, according to the embodiment, the schedule includes the target speed of the web W and the transition start timing to this target speed. Accordingly, in the embodiment, since a degree of a change in conveying speed can be recognized by using the transition start timing as a time point at which the conveying speed of the web delivery device 1 or the cutting device 5 changes, a more accurate feedforward control can be realized.

Further, according to the embodiment, the schedule includes the acceleration to the target speed of the web W. Accordingly, in the embodiment, since the conveying speed of the web delivery device 1 or the cutting device 5 at an arbitrary time from the transition start timing can be more accurately recognized until the conveying speed of the web delivery device 1 or the cutting device 5 reaches the target speed, a more accurate feedforward control can be realized.

Further, according to the embodiment, the first control unit 6 calculates a difference between the conveying speed of the web W in the web delivery device 1 and the conveying speed of the web W in the cutting device 5 and feedforward-controls a position of the pressing member 3*a* on the basis of this difference. Thus, according to the embodiment, since both the conveying speed of the web delivery device 1 and the conveying speed of the cutting device 5 are considered, a more accurate feedforward control can be realized.

Subsequently, a modified example of an operation of the web treatment device will be described. In the description of the above-described operation, the first control unit 6 controls a position of the pressing member 3*a* such that it matches a change in conveying speed of the web delivery device 1 and a change in conveying speed of the cutting device 5. For example, as shown in FIG. 5, the height of the pressing member 3*a* changes to match a period during which the conveying speed of the web delivery device 1 and the conveying speed of the cutting device 5 change (see a graph A shown in FIG. 5).

Figure 5:
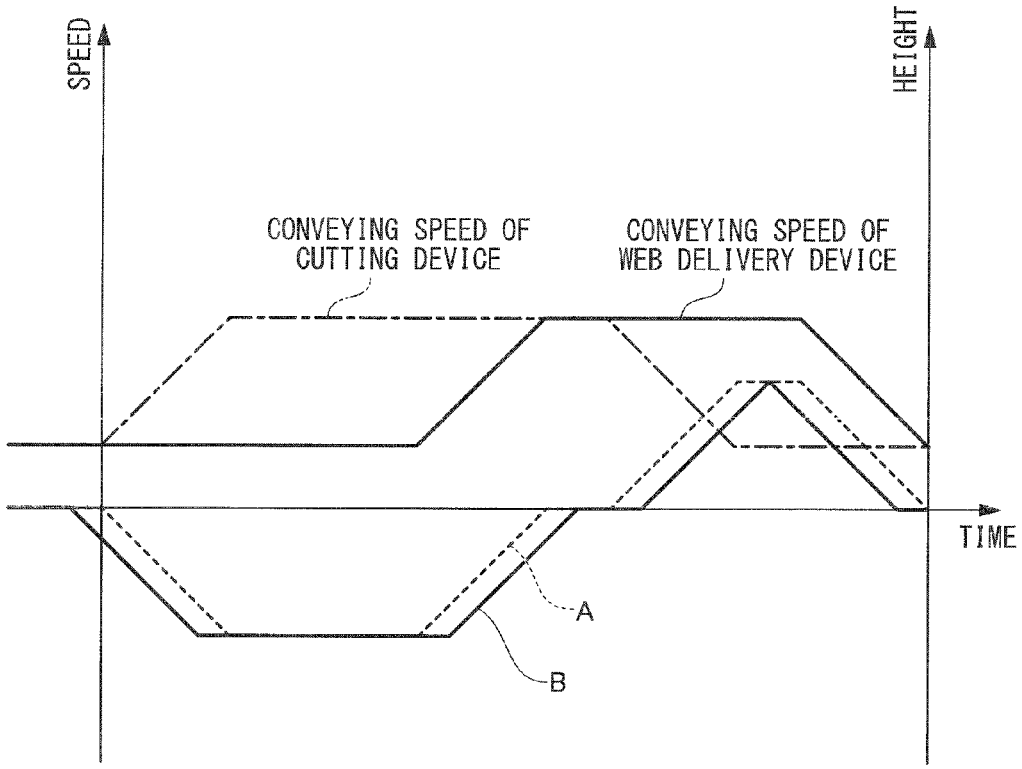
FIG. 5 is a diagram a change in height of a pressing member in response to a change in conveying speed of a web delivery device and a cutting device of the embodiment of the present disclosure.

Meanwhile, in the modified example, a control is performed in which a height of the pressing member 3*a* is displaced in time in accordance with a change in conveying speed of the web delivery device 1 and a change in conveying speed of the cutting device 5 (see a graph B shown in FIG. 5). Here, the first control unit 6 allows a change in the pressing member 3*a* to be slower than a change in conveying speed of the web W in a case where the conveying speed of the web delivery device 1 is increased and the conveying speed of the cutting device 5 is decreased. Specifically, the first control unit 6 slightly delays a timing at which a pressing force control is performed from a time indicated by the schedule stored in the first control unit or input from the outside and relating to the conveying speed of the web W in the web delivery device 1 and the cutting device 5. As a result, since the pressing member 3*a* moves upward after the web W is slightly bent, an excessive tension applied to the web W can be prevented.

Further, the first control unit 6 allows a change in the pressing member 3*a* to be faster than a change in conveying speed of the web W in a case where the conveying speed of the web delivery device 1 is decreased and the conveying speed of the cutting device 5 is increased. Specifically, the first control unit 6 slightly advances a timing at which a pressing force control is performed from a time indicated by the schedule stored in the first control unit or input from the outside and relating to the conveying speed of the web W in the web delivery device 1 and the cutting device 5. As a result, since the pressing member 3*a* moves downward before a tension applied to the web W increases, an excessive tension applied to the web W can be prevented.

While the embodiment of the present disclosure has been described, the present disclosure is not limited to the above-described embodiment and can be modified, for example, as below. (1) In the above-described embodiment, the web treatment device includes the web delivery device 1 which is the upstream device and the cutting device 5 which is the downstream device, but the present disclosure is not limited thereto. For example, the upstream device may be a processing device like the cutting device 5 which processes the web W. Further, the downstream device may be a processing device such as a coating device other than the cutting device 5 or a conveying device which conveys the web W.

(2) In the above-described embodiment, the pressing member 3*a* of the air turn bar 3 moves in the up/down direction, but, for example, in a case where the web W is conveyed not in the horizontal direction but in the up/down direction, the pressing member 3*a* may move not in the up/down direction but in the horizontal direction so that the pressing member 3*a* presses the web W in a direction orthogonal to the conveying direction.

(3) In the above-described embodiment, the first control unit 6 controls both the web delivery device 1 and the air turn bar 3, but for example, the web delivery device 1 and the air turn bar 3 may be respectively controlled by different control devices.

INDUSTRIAL APPLICABILITY

According to the present disclosure, a delay in responsiveness of a tension control can be improved compared to the related art.

What is claimed is:

1. A tension control device comprising:

a turn bar which is disposed between an upstream device delivering a belt-shaped web and a downstream device receiving the web and of which a pressing member presses the web in a direction substantially normal to a conveying surface of the web in the vicinity of a guide surface of the pressing member; and a control unit which feedforward-controls a pressing force applied from the turn bar to the web on the basis of a schedule relating to a web conveying speed of any one of the upstream device and the downstream device.

2. The tension control device according to claim 1, wherein the schedule includes a target speed of the web and a transition start timing to the target speed.

3. The tension control device according to claim 2, wherein the schedule includes an acceleration to the target speed of the web.

4. The tension control device according to claim 1, wherein the control unit calculates a difference between the web conveying speed of the upstream device and the web conveying speed of the downstream device and performs the feedforward control on the basis of the difference.

5. The tension control device according to claim 1, wherein when at least one of an increase in web conveying speed of the upstream device and a decrease in web conveying speed of the downstream device is performed, the control unit controls the pressing force at a time later than a time indicated by the schedule.

6. The tension control device according to claim 1, wherein when at least one of a decrease in web conveying speed of the upstream device and an increase in web conveying speed of the downstream device is performed, the control unit controls the pressing force at a time earlier than a time indicated by the schedule.

7. A conveying device comprising:

an upstream device which delivers a belt-shaped web;

a downstream device which receives the web; and the tension control device according to claim 1.

8. A conveying device comprising:

an upstream device which delivers a belt-shaped web;

a downstream device which receives the web; and the tension control device according to claim 2.

9. A conveying device comprising:

an upstream device which delivers a belt-shaped web;

a downstream device which receives the web; and the tension control device according to claim 3.

10. A conveying device comprising:

an upstream device which delivers a belt-shaped web;

a downstream device which receives the web; and the tension control device according to claim 4.

11. A conveying device comprising:

an upstream device which delivers a belt-shaped web;

a downstream device which receives the web; and the tension control device according to claim 5.

12. A conveying device comprising:

an upstream device which delivers a belt-shaped web;

a downstream device which receives the web; and the tension control device according to claim 6.

* * * * *